United States Patent [19]

Thomas, Jr.

[11] 3,955,548

[45] May 11, 1976

[54] FUEL/AIR MIXING DEVICE FOR INTERNAL COMBUSTION ENGINE CARBURETOR

[75] Inventor: Charles W. Thomas, Jr., Flatwoods, Ky.

[73] Assignees: Burgess F. Stewart, Russel; William F. Wilburn, Raceland, both of Ky.

[22] Filed: July 19, 1974

[21] Appl. No.: 490,088

[52] U.S. Cl. ..... 123/141; 123/119 E; 48/180 R

[51] Int. Cl.[2] ..... F02M 29/00

[58] Field of Search ..... 123/141, 119 E; 48/180 R, 180 M, 180 S, 180 C, 180 B; 261/84

[56] References Cited

UNITED STATES PATENTS

| | | | |
|---|---|---|---|
| 1,435,888 | 11/1922 | Bancroft | 123/141 X |
| 1,873,082 | 8/1932 | Vostrez | 123/141 |
| 2,657,123 | 10/1953 | Goldman | 123/141 X |
| 3,077,391 | 2/1963 | Guffra | 123/141 X |
| 3,544,290 | 12/1970 | Larson | 123/141 X |

*Primary Examiner*—Charles J. Myhre
*Assistant Examiner*—Ira S. Lazarus
*Attorney, Agent, or Firm*—Cushman, Darby & Cushman

[57] ABSTRACT

In the device provided, air/fuel mixture for an internal combustion engine passes through a conventional carburetor where vaporized fuel and aspirated liquid fuel droplets are mixed witth the air. The device comprises a conduit for conveying the carbureted mixture from the carburetor to an intake manifold. The conduit has an upper opening and a lower opening. A rotatable turbulence producing means, such as a freely rotatable impeller, is disposed in the conduit near the lower opening. The rotatable means rotates about a vertical axis by passage of the carbureted air/fuel mixture therethrough and turbulence of the mixture is produced. Liquid fuel droplets are engaged by a collector and vaporizing means which is disposed in the conduit near the upper opening and above the rotatable means. The collector and vaporizing means has a substantially enclosed central portion disposed axially above the vertical axis of the rotatable and outer portions slopingly connected to and disposed above the central portion. The outer portions have openings in at least the uppermost parts thereof for receiving and collecting aspirated liquid fuel droplets. A fuel droplet discharge opening is in the central portion and the discharge opening is positioned essentially axially of the vertical axis of the rotatable means.

3 Claims, 5 Drawing Figures

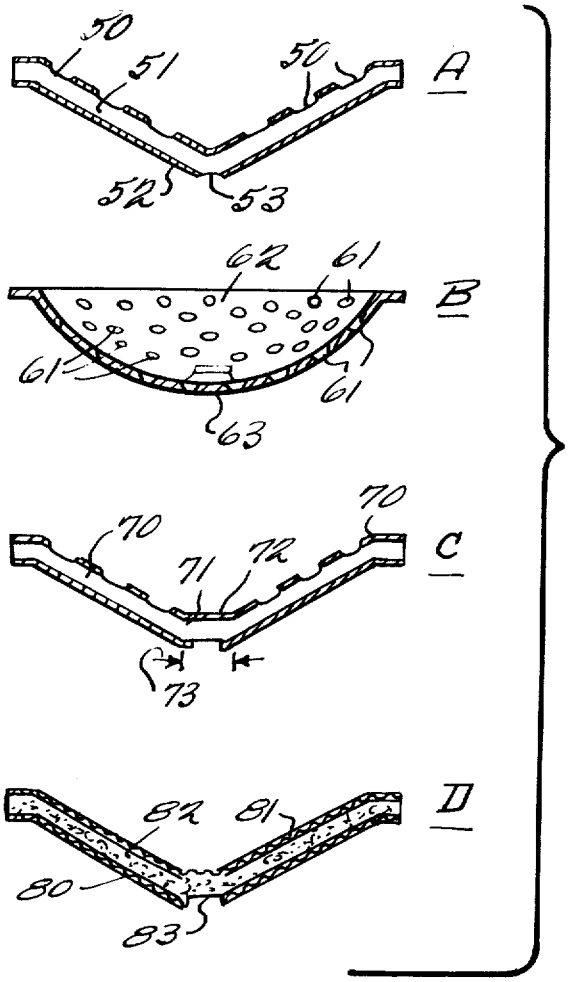
Fig. 3
Fig. 4
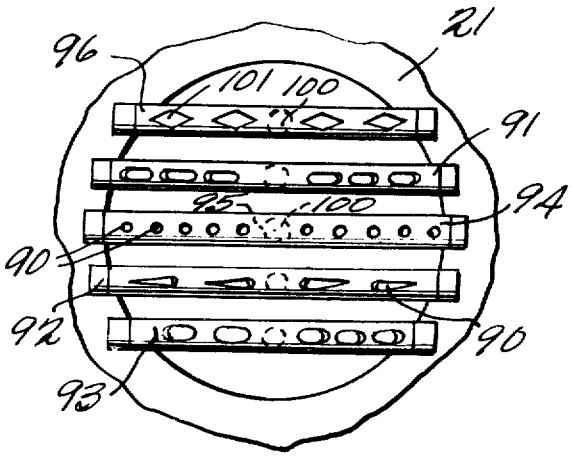
Fig. 5
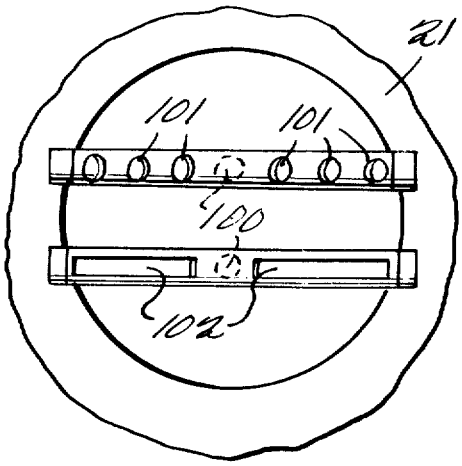

FUEL/AIR MIXING DEVICE FOR INTERNAL COMBUSTION ENGINE CARBURETOR

The present invention relates to a device for improving the efficiency of conventional carburetors, especially conventional downdraft carburetors. The device is intended to function upon carbureted air/fuel mixtures to increase the vaporization of aspirated liquid fuel droplets and thereby increase the efficiency of the mixture for combustion in an internal combustion engine.

BACKGROUND OF THE INVENTION

In conventional internal combustion engine carburetors, liquid fuel is aspirated into an airstream whereby small droplets of the fuel are entrained into the airstream during passage of the airstream from the carburetor to the cylinders of the internal combustion engine. The droplets are vaporized from the liquid state to the gaseous state and mixed with the air drawn through the carburetor. This mixture of vaporized fuel and air is then ignited within the cylinders of the internal combustion engine to provide power and movement to the engine.

As is well known in the art, carburetor devices of that nature are essentially compromises between efficiency and volumetric air/fuel throughputs of magnitudes great enough to provide sufficient power for high speed driving. While this comprise does allow operation of the internal combustion engine over wide ranges of speed and power requirements, the compromise also inherently provides for low effeiciency of carburetion of the fuel at certain operational speeds and for certain power requirements.

The art has long sought for modifications to conventional carburetors whereby increased efficiency of the internal combustion engine is obtained with subsequent further mixing and/or vaporization of the carbureted air/fuel mixture. Generally speaking, these efforts have centered around devices to be placed between the carburetor and the intake manifold to accomplish additional mixing and/or vaporization of the carbureted fuel prior to passage into the intake manifold. These devices have taken various forms in the prior art. For example, turbulence creating means and heat producing means have been placed between the carburetor and the intake manifold. Embodiments of the former include baffles, screens, perforated plates, tortuous paths created by metal turnings, foams, etc., and the latter of these includes hot exhaust gas injected into the air/fuel mixture, electrical heater elements disposed in the path of the air/fuel mixture, tubular heat exchangers through which the hot exhaust gas passes, and the like.

A difficulty often encountered by many of these devices is the lack of operational adjustability which will allow for different volumetric throughputs of carbureted air/fuel mixture, corresponding to different engine speeds and power requirements. For example, perforated plates and screen wires have constant openings thereof, and the volumetric throughput of the mixture which is occasioned by different engine speeds and power requirements does not create correspondingly different degrees of turbulence. Unfortunately, for increased efficiency, the turbulence created by the devices should be varied from low speeds and power requirements to higher speeds and power requirements, since the different degrees of turbulence are required to correctly augment the natural turbulence created by the carburetor which is greater at higher speeds than at lower speeds. The same is true for heater devices which function with exhaust gases. Thus, at higher speeds greater amounts of hot gases are available and at lower speeds lesser amounts of hot gases are available.

Of the prior art devices, one approach obviates the difficulties mentioned above. In this approach a rotatable turbulence producing means is placed between the carburetor and the intake manifold. While the turbulence producing means may take various forms, the general configuration thereof approximates the shape of a fan-type impeller. With this arrangement, the speed of rotation of the impeller, and hence the amount of the turbulence produced, is directly dependent upon the volumetric throughput of the carbureted air/fuel mixture. Thus, at higher speeds and at greater engine power requirements where the volumetric throughput is greater, the angular speed of rotation of the impeller is greater and, correspondingly, greater turbulence and mixing of air/fuel are provided. On the other hand, at lower speeds and engine power requirements, the volumetric throughput of the air/fuel mixture is less and, accordingly, the turbulence and mixing of air/fuel produced by the impeller are less. In other words, the rotatable impeller inherently adjusts in the speed of rotation whereby it corresponds to the engine speed and power requirements.

While the impeller device is, therefore, a preferred form of the turbulence producing devices, it also suffers from a decided disadvantage. This device is quite capable of intimately mixing already vaporized fuel with the carbureted air, and therefore increases the efficiency of the internal combustion engine, but the device is not capable of significantly vaporizing liquid fluel droplets aspirated into the air/fuel mixture during carburetion. These liquid droplets pass through the impeller device with, essentially, no more vaporization than is accomplished with the conventional carburetor. While the combintion of the impeller and a heat producing device, as described above, could be useful to both mix the fuel by action of the impeller and vaporize the droplets by action of the heat, known heat producing devices still suffer from being non-adjustable with engine speeds and power requirements as discussed above.

In view thereof, it would be desirable in the art to provide a means, in combintion with impeller mixing devices, which can increase the degree of vaporization of aspirated liquid fuel droplets. The increased vaporization along with the additional mixing of the vaporized fuel and air, occasioned by the impeller, would significantly increase the efficiency of the internal combustion engine.

OBJECTS OF THE INVENTION

It is therefore an object of the invention to provide a device for vaporizing aspirated liquid fuel droplets, which device is used in combination with the impeller turbulence producing device, known to the prior art. It is a further object of the invention to provide such device which is inherently adjustable to the engine speed and power requirements for vaporizing greater amounts of liquid fuel droplets at higher speeds and engine requirements. Other objects will be apparent from the following disclosures and claims.

BRIEF DESCRIPTION OF THE INVENTION

Briefly stated, the present invention provides a device for vaporizing fuel into the air of a carbureted air fuel mixture for an internal combustion engine wherein the carbureted mixture contains air, vaporized fuel and aspirated liquid fuel droplets. The device comprises a conduit means for conveying the carbureted mixture from a carburetor to an intake manifold of an internal combustion engine. The conduit means has an upper carburetor side opening and a lower intake manifold discharge side opening. A rotatable turbulence producing means is disposed in the conduit means near the lower opening. The rotatable means is capable of rotation about a vertical axis thereof by passage of carbureted mixture therethrough. That passage of the mixture produces turbulence of the mixture during passage. An aspirated liquid fuel droplet collector and vaporizing means is disposed in the conduit near the upper opening and above the rotatable means. The collector and vaporizing means has (i) a substantially enclosed central portion which is disposed axially above the vertical axis of the rotatable means; (ii) outer portions connected to and disposed above the central portion which outer portions are slopingly connected to the central portion, and the outer portions have openings in at least the uppermost parts thereof for receiving and collecting aspirated liquid fuel droplets; and (iii) a fuel droplet discharge opening in the central portion wherein the discharge opening is positioned essentially axially of the vertical axis of the rotatable means.

The action of the present device is to cause the carbureted fuel mixture (containing air, vaporized fuel and aspirated liquid fuel droplets) to pass through the collector and vaporizing means prior to passing through the impeller means. The collector and vaporizing means collects a substantial amount of the aspirated liquid fuel droplets and conveys those liquid droplets to a central portion which discharges the collected droplets into the axial portion of the impeller. It has been discovered that in the combination of a carburetor and the impeller the axial portion of the impeller creates a substantially increased suction at or near the vertical axis of rotation of the impeller and by discharging the collected fuel droplets at this point, extreme turbulence and mixing of the unvaporized liquid fuel will occur during passage through the impeller. Indeed, the passage is most tortuous and, in a large degree, is transverse to the axis of rotation (outwardly) which considerably lengthens the time and distance that the liquid fuel encounters in passing through the impeller, thus, increasing the degree of vaporization of the liquid fuel.

BRIEF DESCRIPTION OF THE DRAWINGS

FIG. 3 shows various alternate embodiments of the collector and vaporizer means of FIG. 1;

FIG. 4 shows an embodiment wherein a plurality of collector means, as shown in FIG. 1 and modification thereof are disposed above the impeller means; and FIG. 5 is an alternate arrangement to that of FIG. 4, wherein only two collector and vaporizer means are utilized, but the upper openings thereof differ from those of FIG. 4.

DETAILED DESCRIPTION OF THE INVENTION

Figure 1:
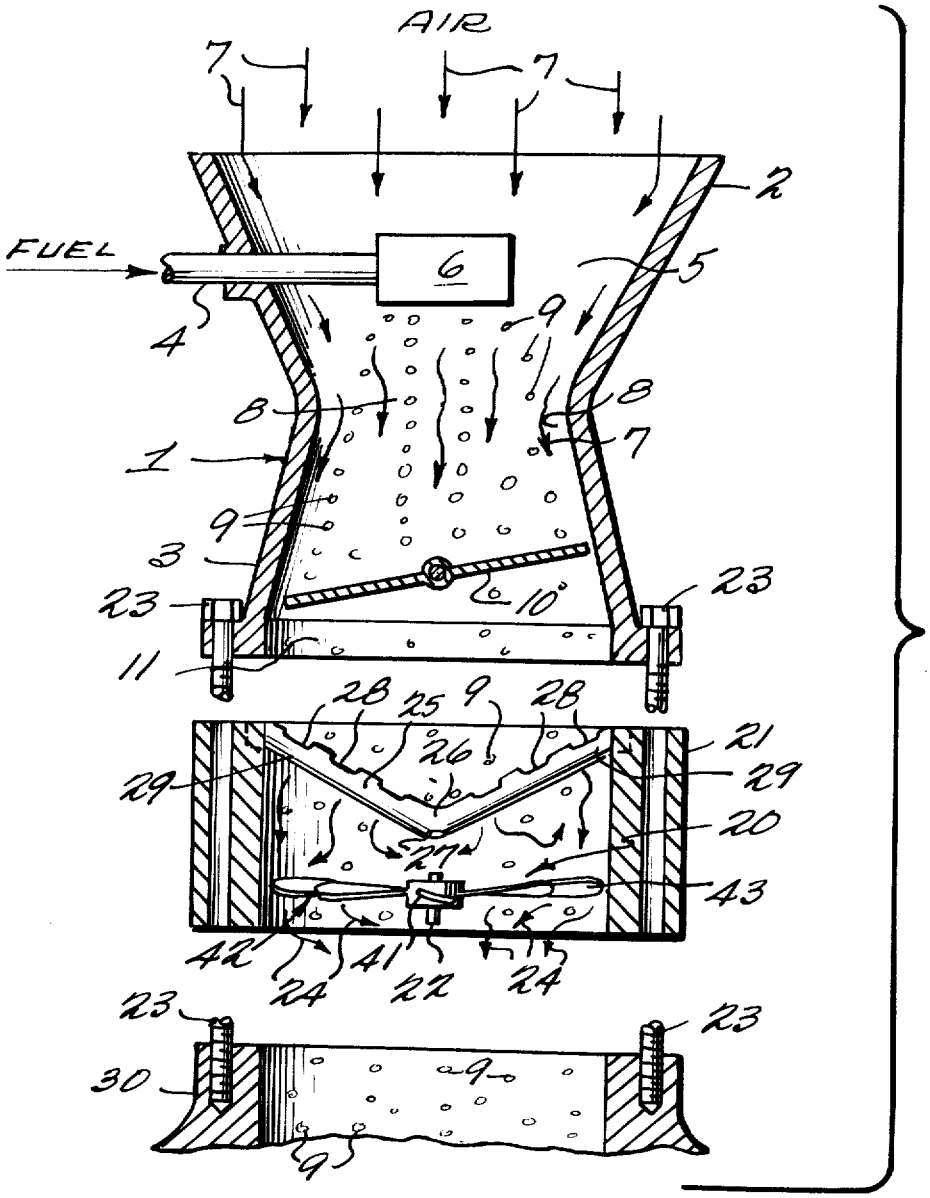
FIG. 1 is a highly idealized schematic illustration of the principles involved in the present invention.

The invention can best understood by reference to the highly idealized and diagrammatic illustration of FIG. 1.

In that illustration, a conventional downdraft carburetor, generally 1 has an entry throat generally 2 and a discharge throat generally 3. According to conventional operation, fuel is passed via a conduit 4, into the throat 5 of the carburetor. A fuel jet 6 has air, indicated by arrows 7, passing thereabout. This passage of the air and the effect of the venturi, generally at 8, causes aspiration of the fuel. The aspiration breaks the fuel into minute liquid droplets, sometimes referred to as atomization, and hundreds of thousands of these droplets are continuously discharged from fuel jet 6 during operation of the carburetor. The actual size of these droplets will vary greatly. The smallest of the droplets will almost immediately vaporized, i.e., the droplet will pass from the liquid droplet state to the vaporized gaseous state of the fuel. Larger of the droplets will vaporize during passage through the carburetor, while even larger of the droplets will vaporize during passage through the intake manifold. However, there are substantial numbers of these droplets which are so large that they do not effectively vaporize in the carburetor and even do not vaprize until just prior to entry into the cylinders of the engine, if they vaporize at all. For these larger droplets, therefore, the opportunity for intimately mixing with the air is considerably reduced, bearing in mind the delay in vaporizing, if they vaporize at all.

In FIG. 1 these larger troublesome droplets are indicated diagrammatically as 9, although it should be understood that the size shown in the drawing is not in proportion to the size of the droplets. It is these troublesome larger droplets to which the present invention is primarily directed.

It should be initially understood that the number of aspirated droplets, the size ranges and proportions of sizes thereof vary with engine speed and power requirements (and therefore the volumetric throughput of air/fuel mixture required for engine use). As the engine speed increases and the volumetric throughput of the carburetor correspondingly increases, the size of the droplets tends to be smaller, while at lower speeds the proportion of larger size droplets tends to increase. As can be appreciated, therefore, the inherent operation of the carburetor in this regard is less efficient at the lower speeds, especially in view of the compromise between efficiency and power requirements discussed above.

The aspirated liquid droplets, vaporized fuel and air then pass through the a conventional control butterfly valve 10 and exit through discharge 11 of the carburetor.

Figure 2:
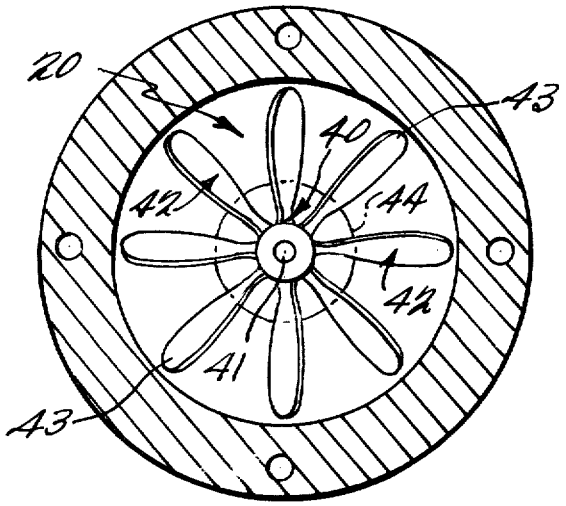
FIG. 2 is a top view of the impeller of FIG. 1.

As noted above, the prior art has proposed an impeller device to be disposed between the carburetor and intake manifold for accomplishing greater mixture of the vaporized fuel and air. In FIG. 1 an impeller 20 (which is a rotatable turbulence producing means is mounted in a conduit 21 (by means not shown but conventional in the art). The conduit means attaches between carburetor 1 and intake manifold 30 by conventional attaching means, indicated by bolts 23. These conventional attaching means may take any desired form, such as bolts, nuts and screws, clamps, etc. Of course, gaskets may be used between carburetor 1 and conduit 21 as well as between conduit 21 and intake manifold 30, if desired. The turbulence producing means, i.e. the impeller, rotates about a vertical axis, indicated as 22 in FIG. 1, and causes mixing of a vaporized fuel and air. The particular form of the turbulence producing device is not critical and may be of a simple bladetype fan. An illustration thereof is shown in FIG. 2 where impeller 40 is mounted on a bearing 41 and has blades 42 generating therefrom. The direction of rotation is immaterial and will be controlled by either the right or left hand pitch of blades 42. The pitch may be from as little as 2° to 3° to as high at 45°, but pitches are generally between about 10° and 25° . The pitch need not be a uniform pitch but can vary across the blade as is well known in the fan art. The flow of fuel/air mixture through the impeller causes the impeller to turn at an angular speed directly proportional to the volumetric throughput of air/fuel. Therefore, the turbulence created by the impeller is also directly proportional to the volumetric throughput. This turbulent motion is indicated, idealizedly, by arrows 24.

As briefly noted above, it has been discovered that in these impeller devices, the axial portion thereof, along the vertical line extending from axis 22, creates an exceptionally strong sucton, as compared to the suction created toward the outer portions of blades 42, i.e., near 43. This suction also creates great turbulence at this point and the turbulence is continued as the air/fuel mixture is spun by the blades of the impeller outwardly and downwardly. This outward and downward travel is substantialy greater than the time and distance occasioned by fuel passing through the outer portions 43 of blades 42. Therefore, any liquid fuel which is presented to the central portion of the impeller has a much greater opportunity to vaporize than liquid droplets passing through the outer part of the impeller. Actually, opportunity for further vaporization of the liquid fuel droplets is generally proportional to the proximity to the axial portion of the impeller into which the droplets are first engaged by the impeller. Therefore, for maximum effect all of the aspirated and unvaporized fuel droplets should be conveyed to the specific axis of rotation of the impeller. This is, of course impractical, but advantages are obtained by conveying as many of these droplets as possible, at least toward the central or axial portion of the fan impeller. Preferably, most of the droplets will be conveyed to an area, the diameter of which is no more than one third of the diameter (as generated from the axis of the impeller). In FIG. 2 the one third diameter area is indicated by the dashed lines 44. Here again, it is not really practical to get all of the droplets conveyed to this one third diameter area, but efforts should be made to get the droplets into or as close to that area as possible.

With the foregoing principles in mind, it will be seen from FIG. 1 that a collector and vaporizing device 25 is disposed above impeller 20 and has a central portion 26 which is, essentialy, above the axial portion of impeller 40. In the central portion 26, at the lowermost part thereof, the collector and vaporizing means has an opening 27. On the upper parts of the collector and vaporizing elements are a plurality of openings 28, which openings will intercept some of the liquid fuel droplets passing through conduit 21. Of course, these openings will not intercept all droplets, but those that are intercepted are collected within the enclosure of collector and vaporizing device 25, and by gravity and the slopingly configuration of outer parts 29 convey the liquid fuel to opening 27. The liquid fuel then drops into the axial portion 44 of impeller 40 and are further vaporized, as explained above.

The collector and vaporizing devices may take various forms, as shown in FIG. 3. Thus, there may be a plurality of holes 50 as shown in embodiment A, which are in the upper part of an enclosure 51. The enclosure is slopingly connected to central portion 52, which has an opening 53 for dropping the fuel onto the central portion of the impeller. This is, essentialy, the device shown in FIG. 1.

Alternately, a dish-shaped device may be provided in the conduit and embodiment B illustrates the same. Here, perforations may be provided in the dish-shape to allow passage of air and vaporized fuel. The perforations 61 will be large enough to not unduly restrict the volumetric flow, but the dish will present sufficient unperforated area 62 as to collect unvaporized fuel droplets and convey those droplets to opening 63, which again, would be positioned above the central portion of the impeller.

The central portion of the collected and vaporizing device need not be a single lowermost point and embodiment C illustrates the same. In this device there are sloping conduits 70, similar to that of embodiment A, but the central portion 71 has a land 72. The length of the land illustrated by arrows 73 could, if desired, correspond to the central portion 44 of the impeller or any part thereof.

The embodiment D illustrates that the collector and vaporizer device may have a simple screened or perforated bottom and top 80 and 81, with a tortuous path material 82 thereon, such as glass wool, metal turnings and the like. The tortuous path material will collect the droplets of unvaporized fuel and convey those droplets to opening 83 for function as described above.

The number of vaporizing and collecting devices can vay considerably. FIG. 4 shows an illustration where there are a total of 5 such devices disposed within conduit 21 (see FIG. 1). These collecting and vaporizing devices may have various numbers of openings 90 and device 91 shows 6 openings while device 92 shows only 4 openings and device 93 shows 5 such openings. As can be appreciated, device 94 is more centrally located and the discharge opening 100, which is under central portion 95, will be axially disposed over the axis of rotation of the impeller. Therefore, device 94 will be more efficient than device 92 or device 96. Similarly, devices 91 and 92 will be more efficient than correspondingly devices 96 and 93.

On the other hand, as few as 1 or 2 collecting and vaporizing devices may be disposed in conduit 21 as shown in FIG. 5. These devices will both have their openings 100 (shown dotted) within the central portion 44 of the impeller. As shown in FIG. 5, the openings 100 at the lowermost part of the device do not have a corresponding upper opening (such as 101) as directly thereover. This is because that an opening directly over discharge opening 100 would create a direct draft through the central most portion of the device and disrupt operation of the liquid fuel from dropping by gravity into the central portion of the impeller.

It should also be appreciated that the openings in the devices need not be perforations or holes but can, indeed, be open troughs 102 all along the device, so long as the opening 100 is enclosed, i.e., does not have a collecting opening thereover.

As can be appreciated from the foregoing, the collecting devices collect the liquid droplets and convey them to the central portion of the impeller or into which the liquid fuel is dropped by gravity and tortuously passed through the impeller to provide opportunity for greater vaporization and therefore greater efficiency of the carburetor air fuel mixture. It will also be apparent that various modifications of the invention will be apparent to those skilled in the art, it is therefore intended that those apparent modifications be embraced by the spirit and scope of the appended claims.

What is claimed is:

1. A device for vaporizing fuel into the air of a carbureted air/fuel mixture for an internal combustion engine wherein the carbureted mixture contains air, vaporized fuel and aspirated liquid fuel droplets, comprising:

1. a conduit means for conveying the carbureted mixture from a carburetor to an intake manifold of an internal combustion engine, said conduit means having an upper carburetor side opening and a lower intake manifold side discharge opening;
2. a rotatable turbulence producing means disposed in the said conduit means near the lower opening, said rotatable means being capable of rotation about a vertical axis thereof by passage of the carbureted mixture therethrough and thereby producing turbulence in the mixture;
3. an aspirated liquid fuel droplet collector and vaporizing means disposed in said conduit near said upper opening and above the said rotatable means, said collector and vaporizing means having:
   i. a substantially enclosed central portion disposed axially above the vertical axis of the said rotatable means,
   ii. outer portions disposed above said central portion and slopingly connected to said central portion, said outer portions having openings in at least the uppermost parts thereof for receiving and collecting aspirated liquid fuel droplets, and
   iii. a fuel droplet discharge opening in said central portion and said discharge opening being located in the proximity of the vertical axis of said rotatable means, said proximity being defined by a diameter generated from the axis of the rotatable means which is no more than one-third of the diameter of the rotatable means.

2. The device of claim 1 wherein the rotatable turbulence producing means is a freely rotatable impeller.

3. The device of claim 1 wherein there are a plurality of the collector and vaporizing means disposed in said conduit.

* * * * *